US006065938A

United States Patent [19]

Bartsch

[11] Patent Number: 6,065,938

[45] Date of Patent: May 23, 2000

[54] ROTOR FOR A TURBOMACHINE HAVING BLADES TO BE FITTED INTO SLOTS, AND BLADE FOR A ROTOR

[75] Inventor: Carsten Bartsch, Berlin, Germany

[73] Assignee: Siemens Aktiengesellschaft, Munich, Germany

[21] Appl. No.: 09/217,862

[22] Filed: Dec. 21, 1998

Related U.S. Application Data

[63] Continuation of application No. PCT/DE97/01159, Jun. 9, 1997.

[30] Foreign Application Priority Data

Jun. 21, 1996 [DE] Germany ..... 196 24 924
Oct. 15, 1996 [DE] Germany ..... 196 42 537

[51] Int. Cl.[7] ..... B64C 11/04; B64C 27/48

[52] U.S. Cl. ..... 416/219 R; 416/220 R; 416/221; 416/231; 416/248

[58] Field of Search ..... 416/219 R, 220 R, 416/221, 231, 248

[56] References Cited

U.S. PATENT DOCUMENTS 2,643,853 6/1953 Redding ..... 416/221
4,191,509 3/1980 Leonardi ..... 416/219 R
5,372,481 12/1994 Boyd ..... 416/220 R
5,846,054 12/1998 Mannava et al. ..... 416/219 R

FOREIGN PATENT DOCUMENTS

0705958A1 4/1996 European Pat. Off. .
2237846A 5/1991 United Kingdom .
2271817A 4/1994 United Kingdom .

OTHER PUBLICATIONS

Published International Application No. 91/01433 (Massung et al.), dated Feb. 7, 1991.

*Primary Examiner*—Edward K. Look
*Assistant Examiner*—Rhonda Barton
*Attorney, Agent, or Firm*—Herbert L. Lerner; Laurence A. Greenberg; Werner H. Stemer

[57] ABSTRACT

A rotor for a turbomachine has slots formed therein at an angle to an axis of rotation of the rotor. Blades have at least one blade root with at least two regions of different rigidity that are adapted and preferably matched to different regions of rigidity of the slot. The blade roots can be fitted into the slots. A blade for a rotor is also provided. The invention is especially suitable for use in gas-turbine compressors, as a result of which local stresses at slots can be greatly reduced.

17 Claims, 3 Drawing Sheets

ROTOR FOR A TURBOMACHINE HAVING BLADES TO BE FITTED INTO SLOTS, AND BLADE FOR A ROTOR

CROSS REFERENCE TO RELATED APPLICATION

This application is a continuation of International Application No. PCT/DE97/01159, filed Jun. 9, 1997,which designated the United States.

BACKGROUND OF THE INVENTION

1. Field of the Invention

The present invention relates to a rotor for a turbomachine having blades which can be fitted into slots, wherein the slots are made at an angle to an axis of rotation of the rotor. The invention also relates to a blade for a rotor.

In rotors of turbomachines, high centrifugal forces may occur due to the rotation. In the case of blades which can be fitted in a rotor, there is also the difficulty of constructing the rotor in such a way that it on one hand has adequate strength but on the other hand does not exceed certain dimensional limits, which depend on the loads imposed on the turbomachine. The blades which can be fitted into slots must have a suitable blade root for that purpose. Depending on the structural principle of the connection between blade root and rotor, different stresses occur between the same. Those stresses are distributed in a varying manner over the blade root. One parameter influencing the stresses which occur during operation of the turbomachine is, for example, the installation angle of the blade root in the shaft.

UK Patent Application GB 2 237 846 A relates to a gas turbine for an airplane power plant, which describes a reduction in the mass of the rotor to increase safety when operating at maximum speed. That mass reduction is achieved by providing the roots of the turbine blades with two parts which are separated and spaced apart from each other by a continuous slot. Those parts of the blade roots are spaced apart from each other by two partitions which leads to a spreading of the blade roots.

2. Summary of the Invention

It is accordingly an object of the invention to provide a rotor for a turbomachine having blades to be fitted into slots, and a blade for a rotor, which overcome the hereinaforementioned disadvantages of the heretofore-known devices of this general type, which reduce strength problems occurring during operation of a rotor and which provide a combination of blade root and slot suitable for this purpose.

With the foregoing and other objects in view there is provided, in accordance with the invention, a rotor for a turbomachine, in particular a turbocompressor, comprising an axis of rotation, slots formed at an angle to the axis of rotation, the slots having different regions of rigidity; and blades having blade roots to be fitted into the slots, at least one of the blade roots having at least two regions of different rigidity adapted and preferably matched to the different regions of rigidity of the slot.

In accordance with another feature of the invention, a correspondingly adapted region of the blade root and a more rigid region, in comparison thereto, of the slot bear against one another or are located opposite one another. This achieves the effect of causing corresponding rigidity values of the slot and the blade root to correspond to one another in such a way that the stresses occurring are evened out overall. In particular, the flow of force during the transmission of force from the blade root into the slot can be rendered favorable given appropriate adaptation.

In accordance with a further feature of the invention, a region of reduced rigidity of the blade root bears against a slot region of maximum stress, in general especially in a region of acute corners of the slot in the rotor, so that no stresses which lead to destruction or material fatigue during prolonged operation of the turbomachine occur during operation of the turbomachine.

In accordance with an added feature of the invention, loads at the slot and loads at the at least one blade root are matched in accordance with forces prevailing in a mainly used turbomachine operating range.

With the objects of the invention in view, there is also provided a blade for a rotor of a turbomachine, comprising a blade root having a form adapted to a slot geometry of slots formed in the rotor, the blade root having two mutually oppositely disposed end surfaces and a rigidity reducing material reduction, preferably at least one recess, in the vicinity of the end surfaces.

In accordance with a concomitant feature of the invention, the blade root has an interior, and the at least one recess, preferably a bore or a milled-out portion, runs from one of the end surfaces into the interior of the blade root.

Other features which are considered as characteristic for the invention are set forth in the appended claims.

Although the invention is illustrated and described herein as embodied in a rotor for a turbomachine having blades to be fitted into slots, and a blade for a rotor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Referring now to the figures of the drawings in detail, it is seen that an advantageous and preferred development of the invention is described below with reference to a gas-turbine compressor, which is a preferred turbomachine for the use of the invention. A rotor of the turbomachine is preferably formed from rotor discs 1 disposed axially one behind the other, interlocked with one another (at serrations) and connected to one another by a non-illustrated tie rod.

Figure 1:
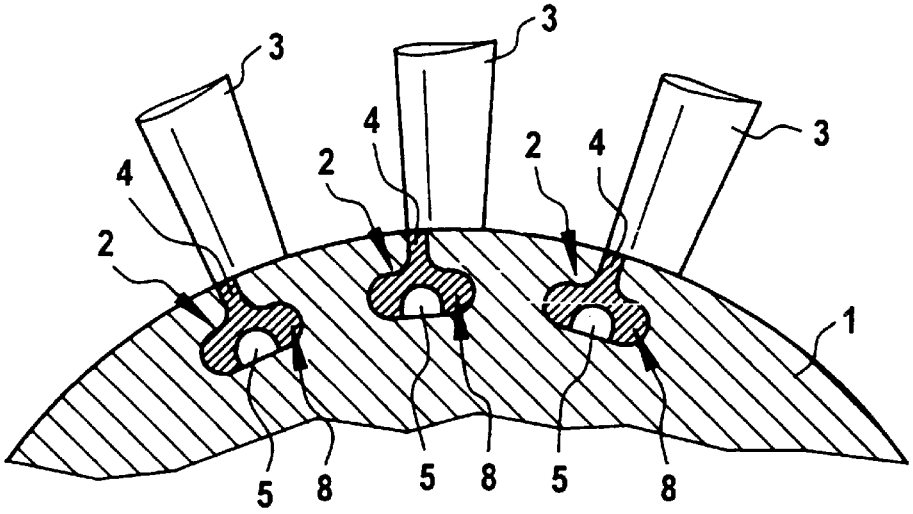
FIG. 1 is a fragmentary, diagrammatic, cross-sectional view of a rotor having blades adapted and inserted according to the invention.
Figure 2:
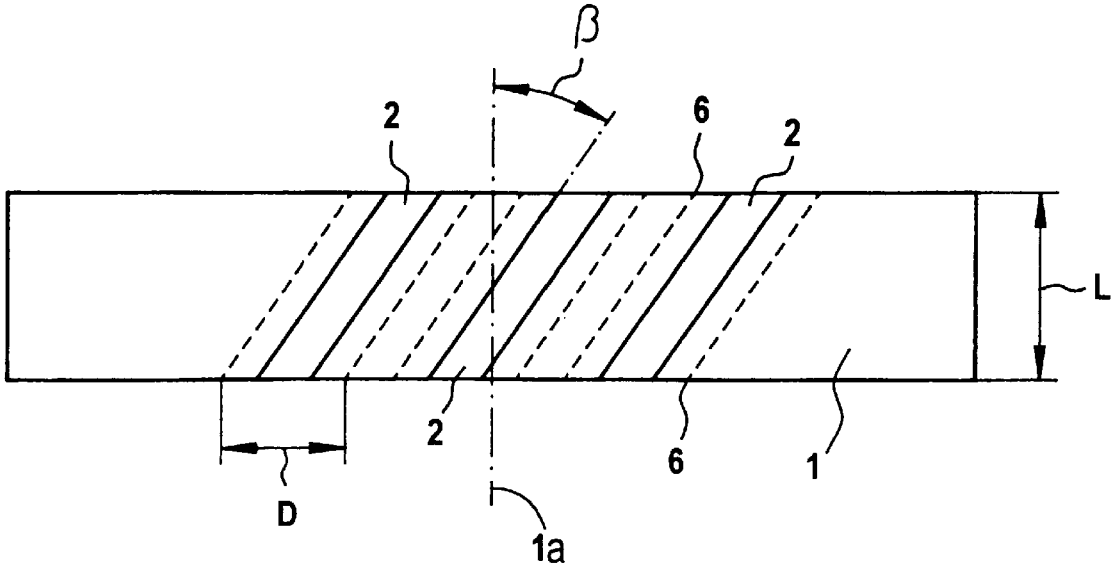
FIG. 2 is a plan view of the rotor of FIG. 1 without inserted blades.

FIG. 1 shows a section of a rotor disc 1 having blades 3 inserted in slots 2 formed in a rotor body. Each blade 3 has regions of different rigidity. A recess 5 is suitably made for this purpose in a blade root 4 in such a way that the rigidity of the blade root 4 is adapted opposite the slot 2. The rigidity of the slot 2 has an uneven magnitude over its slot depth. The slot 2 has an acute corner 6 which lies at a slot end, as is seen in FIG. 2. Since increased stresses occur in particular at the acute corner 6 during operation of the gas-turbine compressor, the recess 5 in the blade root 4 is constructed in this region in such a way as to provide slight flexibility at this point. An advantageous configuration of the recess 5 is provided in the form of a milled-out portion which runs downwards at an angle out of the blade root 4 at an end surface 8 of the latter.

FIG. 2 shows the rotor disc 1 of FIG. 1 in a plan view. The slots 2 are made in the rotor body at an installation angle β to an axis of rotation 1*a* of the body of the rotor disc 1. The angle β may be a great deal larger than conventional installation angles due to the adapted blade roots 4. This is especially important in particular for gas turbines and their compressors having low mass flow. Larger blade angles and thus larger installation angles β may be necessary there. That in turn leads to increased local stresses in the slot 2, since there is reduced rigidity due to the increased angles, in particular at the acute corners 6. The acute corners 6 are locations of locally high stress. They are drawn as ends with a slot width D indicated by broken lines and lying on the inside in the rotor disc 1. As viewed over a slot length L, the slot has different regions of different stresses not only in its depth but also in its extent. The stresses therefore have a different effect on strength when the blade root 4 is installed and during operation of the turbomachine.

Figure 3:
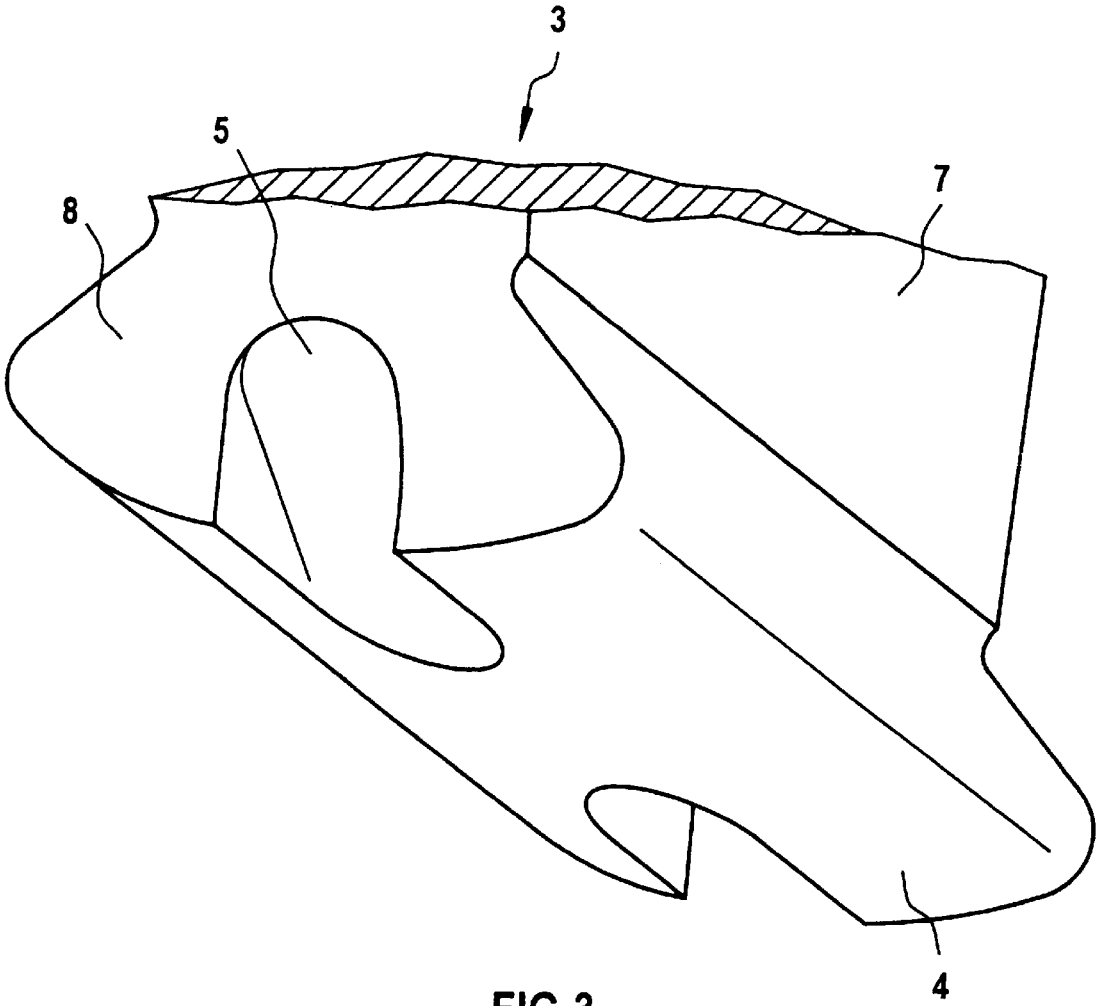
FIG. 3 is a fragmentary, perspective view of a blade root according to the invention.

FIG. 3 shows a blade root 4 according to the invention with an indicated extension of a body 7 of the blade 3. The blade root 4 has recesses 5 each starting at an end surface 8. The recesses 5 run downwards at an angle out of the blade root 4. This material reduction in the blade root 4 leads to reduced rigidity in the regions of the end surfaces 8 as well as in the adjoining regions of the blade root 4. Such adapted regions have greater elasticity, so that deformations occurring during operation, in particular at the acute corners 6, are absorbed in a more favorable manner.

Figure 4:
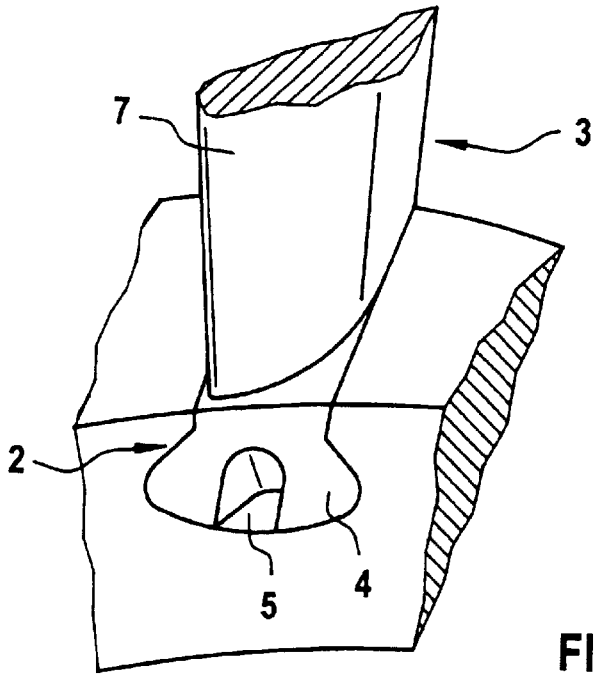
FIG. 4 is a fragmentary, perspective view of the blade root of FIG. 3 inserted in a rotor disc.

FIG. 4 shows the blade 3 of FIG. 3 in the installed state. The material reduction 5 in the blade root 4 leads to lines of force in the body 7 of the blade 3 being interrupted and to loads which occur due to the acting blade forces at the body 7 of the blade being deflected at these points opposite the blade root 4 into the center region of the slot length L through the adapted blade root 4 and being absorbed there through the slot 2.

Figure 5:
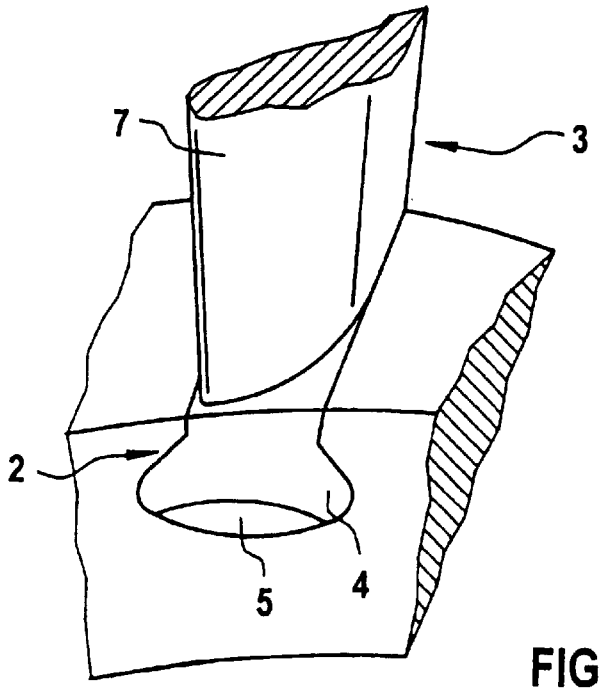
FIG. 5 is a fragmentary, perspective view of a further blade root which is inserted according to the invention.

FIG. 5 shows a further embodiment of the invention. The installed blade root 4 has a recess 5 in a more elongated form, which is drawn downwards out of the blade root 4 towards the center of the slot depth. This recess can be obtained not only through the use of milling but also by drilling or similar machining methods. Within the scope of the invention, however, it is not only recesses 5 which are to be understood as adaptations of the rigidity of regions of the blade root 4. On the contrary, all measures which change the rigidity of a blade root in at least one region can be used. For example, it is also possible to use or work another material in the blade root 4, in which the material has higher elasticity than the latter. In particular, it is favorable in compressors or general turbomachines, which are run in variable operation, for an adaptation of the regions of the blade root 4 to be based on that operating range of the turbomachine in which the latter is mainly run.

In the example presented, depending on the size of the recess and the obliquity of the installation angle, the invention brings about a reduction in local stresses of 30% and more. The advantage of the invention is its low cost, its effectiveness as well as the subsequent adaptation of the rigidity of blade roots in turbomachines already put into operation. A further advantage of the invention is the interchangeability of the blades. Thus blade roots with and without material reduction may be fitted together in a rotor disc.

I claim:

1. A rotor for a turbomachine, comprising:

a rotor body having an axis of rotation, said rotor body having slots formed therein at an angle to said axis of rotation, each one of said slots defining a first region with a rigidity and a second region with a rigidity that is different from said rigidity of said first region; and blades having blade roots to be fitted into said slots, at least one of said blade roots having a first region with a rigidity being adapted to said rigidity of said first region of one of said slots for evening out stresses and a second region with a rigidity being adapted to said rigidity of said second region of said one of said slots for evening out stresses, said rigidity of said first region of said at least one of said blade roots being different from said rigidity of said second region of said at least one of said blade roots.

2. The rotor according to claim 1, wherein said first region and said second region of said at least one blade root are respectively matched to said first region and said second region of said one of said slots.

3. The rotor according to claim 1, wherein said at least one blade root has a given adapted region, said slot has a given region more rigid than said given adapted region, and said given regions bear against one another.

4. The rotor according to claim 1, wherein said at least one blade root has a given adapted region, said slot has a given region more rigid than said given adapted region, and said given regions are located opposite one another.

5. The rotor according to claim 1, wherein said slot has a region of maximum stress, and said at least one blade root has a region of reduced rigidity bearing against said region of maximum stress.

6. The rotor according to claim 1, wherein said slot has a region of maximum stress, and said at least one blade root has a region of reduced rigidity bearing against said region of maximum stress during operation of the turbomachine.

7. The rotor according to claim 1, wherein said at least one of said blade roots is installed in said one of said slots, each one of said slots has a slot end, and said rigidity of said first region of said at least one of said blade roots is a region of reduced rigidity and bears against said slot end of said one of said slots.

8. The rotor according to claim 1, wherein said at least one of said blade roots is installed in said one of said slots, each one of said slots has a slot end with an acute corner, and said rigidity of said first region of said at least one of said blade roots is a region of reduced rigidity and bears against said acute corner of said one of said slots.

9. The rotor according to claim 1, wherein loads at said one of said slots and loads at said at least one blade root are matched in accordance with forces prevailing in a mainly used turbomachine operating range.

10. In a turbomachine including a rotor having a rotor body with an axis of rotation, the rotor body having slots formed therein at an angle to the axis of rotation, and the slots having a slot geometry defining a first region with a rigidity and a second region with a rigidity that is different from the rigidity of the first region, a blade for the rotor, comprising:

a blade root to be fitted into a slot, said blade root having a first region with a rigidity, a second region with a rigidity that is different from said rigidity of said first region of said blade root, and a form adapted to the slot geometry and to the first region and the second region of the slot, and said blade root having two mutually oppositely disposed end surfaces and a rigidity reducing material reduction in the vicinity of said end surfaces.

11. The blade according to claim 10, wherein said rigidity reducing material reduction is at least one recess.

12. The blade according to claim 10, wherein said first region and said second region of said at least one blade root are respectively matched to the first region and the second region of the slot.

13. In a turbomachine including a rotor having a rotor body with slots formed therein having a slot geometry, a blade for the rotor, comprising:

a blade root having a form adapted to the slot geometry, said blade root having two mutually oppositely disposed end surfaces and a rigidity reducing material reduction in the vicinity of said end surfaces.

14. The blade according to claim 13, wherein said rigidity reducing material reduction is at least one recess.

15. The blade according to claim 14, wherein said blade root has an interior, and said at least one recess runs from one of said end surfaces into said interior of said blade root.

16. The blade according to claim 14, wherein said blade root has an interior, and said at least one recess is a bore running from one of said end surfaces into said interior of said blade root.

17. The blade according to claim 14, wherein said blade root has an interior, and said at least one recess is a milled-out portion running from one of said end surfaces into said interior of said blade root.

* * * * *